US007490833B2

(12) United States Patent
Harris et al.

(10) Patent No.: US 7,490,833 B2
(45) Date of Patent: Feb. 17, 2009

(54) SCENT-BASED BOARD GAME

(75) Inventors: Dale Ian Harris, Columbus, OH (US); Russell Pinto, Columbus, OH (US)

(73) Assignee: Unknown Games, LLC, Columbus, OH (US)

( * ) Notice: Subject to any disclaimer, the term of this patent is extended or adjusted under 35 U.S.C. 154(b) by 101 days.

(21) Appl. No.: 11/265,128

(22) Filed: Nov. 3, 2005

(65) Prior Publication Data

US 2006/0113727 A1 Jun. 1, 2006

Related U.S. Application Data

(60) Provisional application No. 60/625,213, filed on Nov. 5, 2004.

(51) Int. Cl.
*A63F 3/00* (2006.01)

(52) U.S. Cl. ..... 273/243; 273/292

(58) Field of Classification Search ..... 273/243, 273/292, 302, 308

See application file for complete search history.

(56) References Cited

U.S. PATENT DOCUMENTS

| | | | | |
|---|---|---|---|---|
| 3,627,325 | A | 12/1971 | Breslow | 273/152.1 |
| 5,918,882 | A | 7/1999 | Truong | 273/249 |
| 6,149,873 | A | 11/2000 | Potter et al. | 422/123 |
| 6,454,263 | B1 | 9/2002 | Bandieri | 273/243 |
| 6,655,686 | B1 | 12/2003 | Morgan | |
| 7,055,823 | B2 * | 6/2006 | Denkewicz, Jr. | 273/304 |
| 2002/0006455 | A1 | 1/2002 | Levine | 426/104 |
| 2003/0006303 | A1 | 1/2003 | Ivey et al. | 239/136 |
| 2003/0109301 | A1 | 6/2003 | Chudley et al. | |
| 2003/0227136 | A1 * | 12/2003 | Denkewicz, Jr. | 273/292 |
| 2004/0026858 | A1 | 2/2004 | Murphy et al. | 273/254 |
| 2004/0067470 | A1 * | 4/2004 | Morris | 434/159 |
| 2004/0212149 | A1 | 10/2004 | Farmer | 273/242 |
| 2006/0108739 | A1 * | 5/2006 | Lutz | 273/292 |

FOREIGN PATENT DOCUMENTS

EP 0508939 A2 10/1992

* cited by examiner

*Primary Examiner*—Vishu K. Mendiratta
(74) *Attorney, Agent, or Firm*—Baker & Hostetler LLP

(57) ABSTRACT

The present invention includes a scent-based board game to challenge the olfactory sense of the player, and a method of play thereof, further including a game board having a start space, an end space and a set of spaces positioned between the start and end space; a scented card having a scent, the identity of the scent and an order; and positional markers. The players progress along the game path by following instructions on the game spaces, identifying the correct scent on the scented cards, and avoiding obstacles. The first player to arrive to the end space is declared as winner.

18 Claims, 8 Drawing Sheets

210
212
214
216
Name
218

220
222
224
226
Name
228

230
232
234
236
Name
238

240
242

244
246a
246b 250
232
252a
252b
252c
252d
252e
252f
200

SCENT-BASED BOARD GAME

CROSS-REFERENCE TO RELATED APPLICATIONS

This application claims priority to provisional U.S. patent application entitled, "SCENT-BASED BOARD GAME," filed Nov. 5, 2004, having a Ser. No. 60/625,213, the disclosure of which is hereby incorporated by reference in its entirety.

FIELD OF THE INVENTION

The present invention relates generally to the art of games for at least one player. More particularly, the present invention relates to the art of board games which utilize the olfactory sense.

BACKGROUND OF THE INVENTION

Games are widely utilized to provide intellectual stimulation for players of all ages. Some games stimulate the players by providing visual challenges, such as, requesting the players to match colors, figures or numbers together. Other games provide intellectual challenge by testing the players knowledge on trivial matters. Typically, these games provide the player with a game path, and the players move along the path as the player successfully meets the challenges.

Although these games provides intellectual challenges for players by asking questions or matching objects, these games fail to directly challenge the senses of the players. Therefore, the players will benefit from a game that can provide direct sensory challenge that involves a little chance and luck.

Accordingly, it is desirable to provide a fun and challenging game where the players use their olfactory sense directly to identify the scents on scented cards to play a game.

SUMMARY OF THE INVENTION

The foregoing needs are met, to a great extent, by the present invention, where in one aspect of this game provides an opportunity for the players to use their olfactory sense to correctly identifying the scents on a scented card as part of playing a game.

In accordance with one embodiment of the present invention, an object of the present invention is to provide a game for at least one player, including a card, a playing path, and a positional marker. The card includes an area having a scent, an identity of the scent, and an order. The playing path includes a start, an end, and a section. The section includes a set of spaces and an action corresponding to a subset of the set of spaces. The game also includes a movement determining device to determine advancement for the positional marker along the playing path.

In accordance with another embodiment of the present invention, another object of this invention is to provide a card having a first side and a second side. The first side includes a scented area, and a second side that includes the identity of the scent and the order. The card includes a scratch and sniff area to generate the scent.

In accordance with yet another embodiment of the present invention, the game can be stored in a variety of suitable formats selected from a group including DVD, CD ROM, diskette, flash drive, hard drive and other storage formats. The game may be played in variable suitable electric gaming devices including handheld computer, desktop computer, laptop computer, cellular telephone, and the like. An odor generating device is used with the electronic formats to emit the scent.

In accordance with yet another embodiment of the present invention, another object of this invention is to provide a method for playing a scent-based board game. In this method, a positional marker is moved along a playing path. The playing path includes a start, an end, and a section having a set of playing spaces. A first subset of the set of spaces includes an instruction, a second subset of the set of spaces corresponding to a scented card, and a third subset of the set of spaces corresponding to an action. In addition, a scent from a card is identified. The card includes an order and corresponds to one of the set of spaces. The order is followed in response to correctly identifying the scent. The positional marker is advanced along the playing path using a movement determining device. Upon correctly identifying the scent, one or more of the following options is chosen: (1) the order indicated on the scented card is performed, (2) remaining at the playing space, or (3) advancing to a next playing space using the movement determining device and following the direction on the space. Upon incorrectly identifying of the scent, the positional marker remains at the playing space.

In accordance with yet another embodiment of the present invention, another object of this invention is to provide an apparatus for playing a scent-based board game. The apparatus includes a means for moving a positional marker along a playing path. The playing path includes a start, an end, and a section having a set of playing spaces. A first subset of the set of spaces includes an instruction, a second subset of the set of spaces corresponding to a scented card, and a third subset of the set of spaces corresponding to an action. In addition, the apparatus includes a means for identifying a scent on a card having an order. The card corresponds to one of the set of spaces. The apparatus further includes a means for following the order in response to correctly identifying the scent and a means for advancing the positional marker along the playing path using a movement determining device. Upon correctly identifying the scent, the apparatus including: means for performing the order indicated on the scented card, means for staying at the playing space, or means for advancing to a next playing space using the movement determining device and follow the direction on the space. Upon incorrectly identifying of the scent, the apparatus including: means for staying at the playing space.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
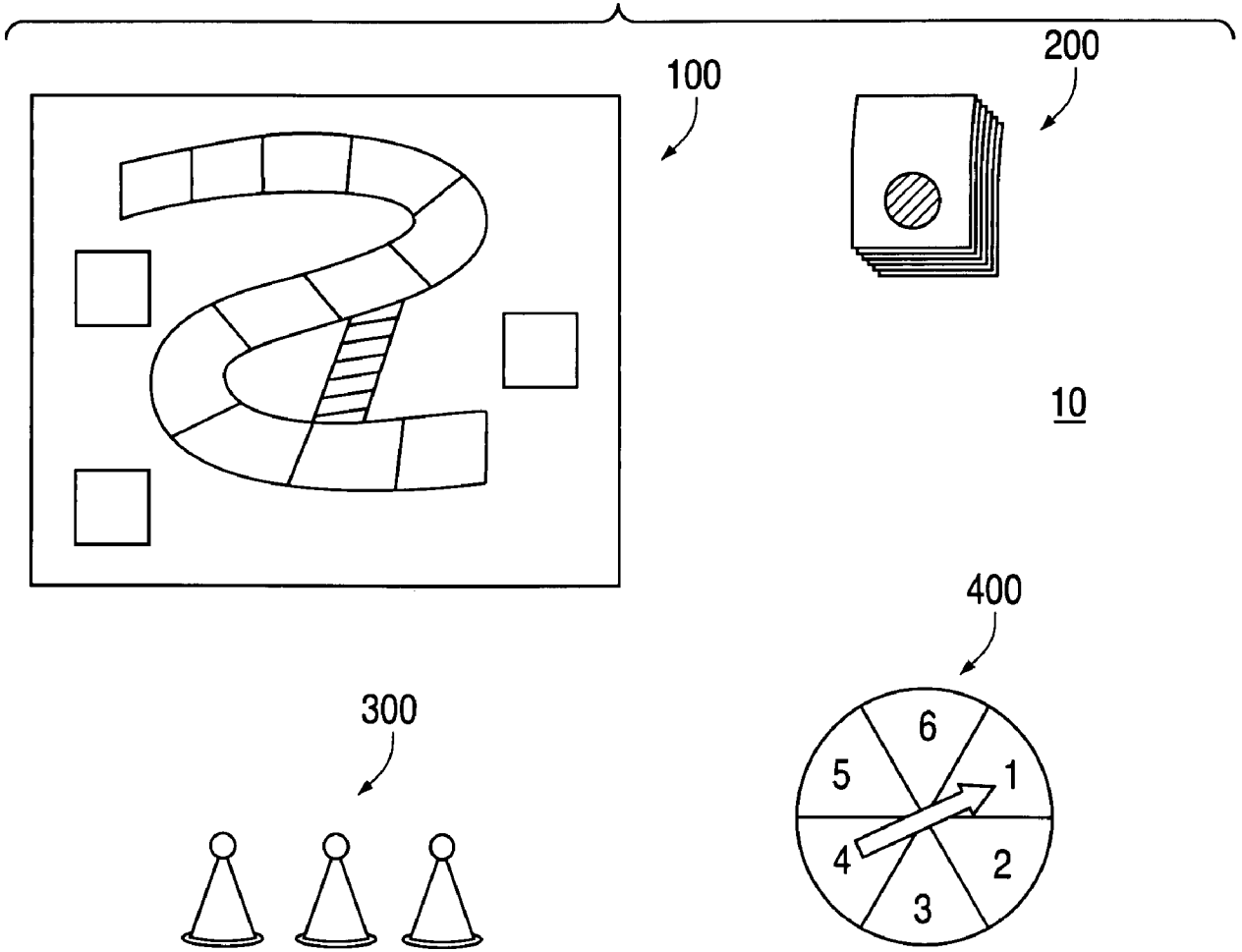
FIG. 1 is an illustration of the various items for playing a board game according to an embodiment of the invention.

The invention will now be described with reference to the drawing figures, in which like reference numerals refer to like parts throughout. An embodiment in accordance with the present invention provides an interactive scent-based board game that directly challenges the olfactory sense of the player and requires the player to correctly identifying a scent on a scented card. The first player (if more than one player) to arrive at the end of a playing path is declared the winner.

The Game

FIG. 1 is block diagram of a game 10 according to an embodiment. As shown in FIG. 1, the game 10 includes: a game surface 100, scent generating device 200, position marker 300, and a movement determinative device 400.

According to various embodiments, the game surface 100 may include any suitable surfaces. Examples of suitable game surface 100 generally include a card board surface, a plastic surface, a cloth surface, a monitor surface, a combinations thereof, or the like.

According to various embodiments, the scent generating device 200 may include any suitable devices. Examples of suitable scent generating devices 200 generally include paper cards, plastic cards, electronic scent generators, and other forms of scent emitting devices.

According to various embodiments, the position marker 300 may include any suitable position marker. Examples of suitable position marker 300 generally include pegs, cardboard cutouts, plastic figures, metal or alloy figures and the like.

According to various embodiments, the movement determinative device 400 may include any suitable movement determinative devices. Example of suitable movement determinative device generally include a die, a custom die, a spinner or a bag with icons and/or a series of numbers, and the like.

In addition, a timing device (not shown), such as a sand clock, clock, watch, or small hourglass, may, optionally, be used in the game so that the player guessing the scent has a fixed amount of time in which to do so.

According to an embodiment, the game of the present invention may be played in various suitable forms. Examples of suitable forms may include a board game, an on-line game via the Internet or bulletin board, or an electronic game and the like. In addition, electronic versions of the game may be stored in a variety of suitable formats. Examples of suitable formats include DVD, CD ROM, diskette, flash drive, hard drive, and the like. Furthermore, electronic version of the game may be played on various suitable devices. Examples of suitable devices include handheld computer, desktop computer, laptop computer, cellular telephone, personal digital assistant, handheld gaming device, television, gaming device (PLAYSTATION®, NINTENDO®, X-BOX®) and the like.

The Game Board

Figure 2:
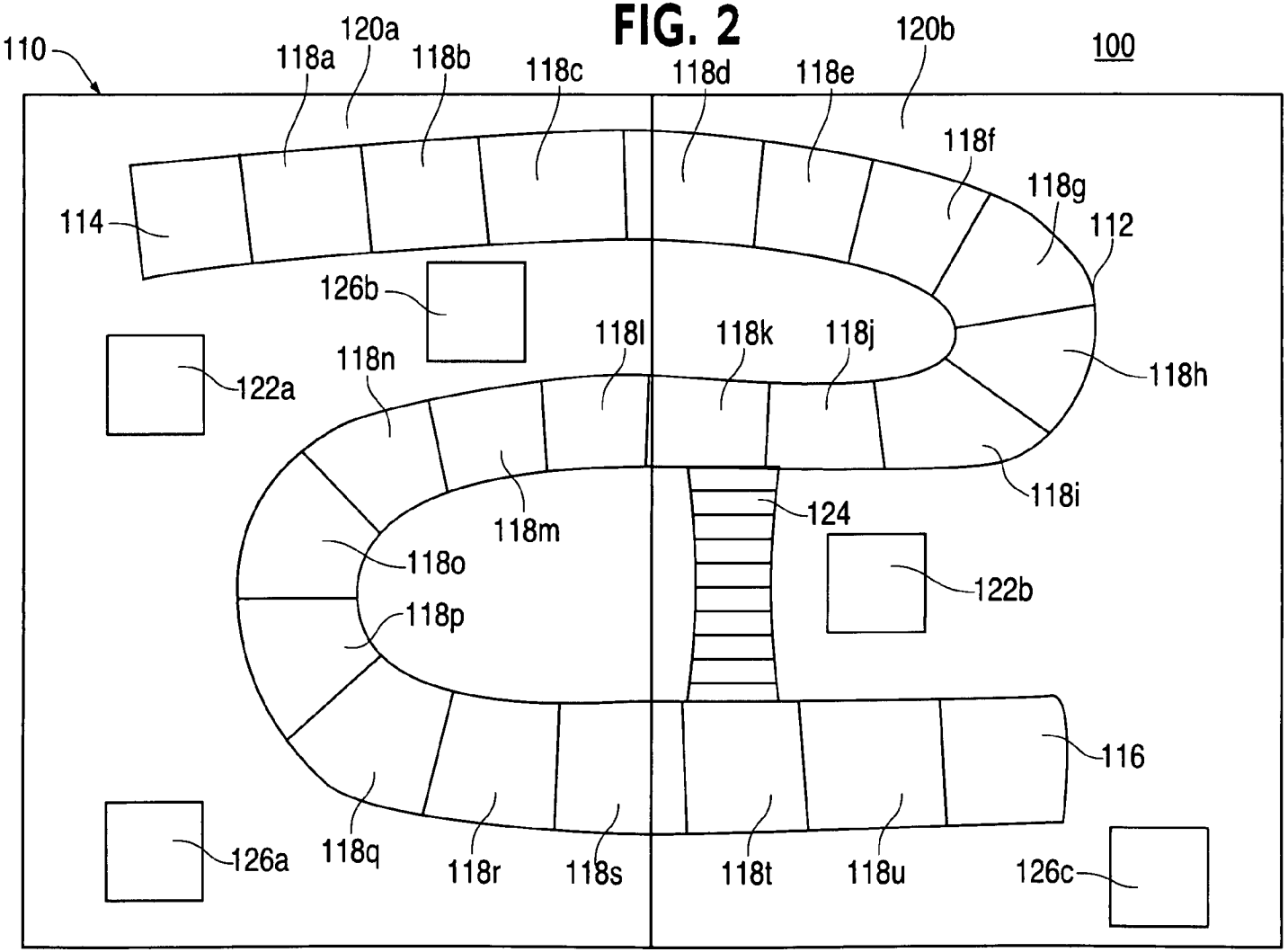
FIG. 2 is an illustration of a game board according to an embodiment of the invention.

FIG. 2 shows an exemplary embodiment of the game surface 100. The game surface 100 has a top surface 110 having a playing path 112. The playing path 112 has a start space 114, an end space 116 and a plurality of playing spaces 118*a*-118*u* disposed in between the start 114 and end space 116. The game surface 100 is also divided into two sections 120*a* and 120*b*, each of the sections 120*a* and 120*b* includes a set of corresponding actions 122*a* and 122*b*. For example, the action 122*a* corresponding to the spaces 118*a*-118*c* and 118L-118*s*. The playing spaces 118*a*-118*u* may further be subdivided into a variety of types of spaces such as, for example, instruction spaces 118*b*, penalty spaces 118*a*, reward spaces 118*e*, smell spaces 118*c*, 118*d*, 118*f*, and the like. The playing path 112 may further include one or more short cuts 124, where the player can skip a number of spaces, obstacles, or penalties by using the shortcut.

When a player lands on a penalty space 118*a* or reward space 118*e*, the player will follow the actions 122*a*, 122*b* that are indicated in the corresponding sections 120*a*, 120*b*. For example, some penalties include: miss a turn, go back to start, move 2, 5 or 10 backwards, draw a bad smell card, draw a mystery smell card, and the like. Some rewards may include: move 2, 5 or 10 steps forward, throw the dice again, draw a good smell card, skip some spaces, move immediately to another space, and the like. These examples are illustrative and not limiting in nature.

The instruction space 118*b* has instructions written on the space. For example, some instructions include: move 2, 5, or 10 steps forward, throw the dice again, miss a turn, go back to start, move 2, 5 or 10, draw a good smell card, draw a bad smell card, draw a mystery smell card, and the like. These examples are illustrative and not limiting in nature.

The game 110 has three types of smell spaces—good smell space 118*c*, bad smell space 118*f*, and mystery smell space 118*h*. Each type of smell space 118*c*, 118*f*, 118*h* corresponds to a specific type of card 210, 220, 230. (See FIG. 3.) For example, good smell spaces 118*c* correspond to good smell cards 210, bad smell spaces 118*f* correspond to bad smell cards 220, and mystery spaces 118*h* correspond to bad smell cards 230. The spaces 118*c*, 118*f*, 118*h* are set apart from each other by their color and design. For example, the good smell space 118*c* has a sun symbol, the bad smell space 118*f* has a skunk symbol, and the mystery space 118*h* has a question mark. The designs, shapes, colors and symbols are illustrative and not limiting in nature.

The game surface 110 also provides areas 126*a*, 126*b*, 126*c* for the placement of the scented generating devices 200. The players may separate the three sets of cards 210, 220, 230 and place them in the respective areas 126*a*, 126*b*, 126*c* of the game surface 110.

The game surface 100 may further include a suitable background setting for the game 10. Examples of suitable backgrounds generally include: a jungle, a chemistry lab, a city scene, a garbage dump, and the like. These examples are illustrative and not limiting in nature.

The playing path 112 may include any suitable form or shape. Examples of suitable forms or shapes generally include: squares, circles, ovals, rectangles, triangles, polygons, serpentine, or irregular shapes. These examples are illustrative and not limiting in nature.

In addition, a surface may be placed over the existing game board. For example, a surface with having different designs or themes may be places over the game board. The surface can be a piece of paper, plastic or other materials with the same or different graphics as the orignial game board. Examples for suitable themes generally include: Christmas, Easter, Thanksgiving, Summer, and the like. These examples are illustrative and not limiting in nature.

The Scent Generating Device

Figures 3A, 3B, 3C, 3D, 3E, 3F:
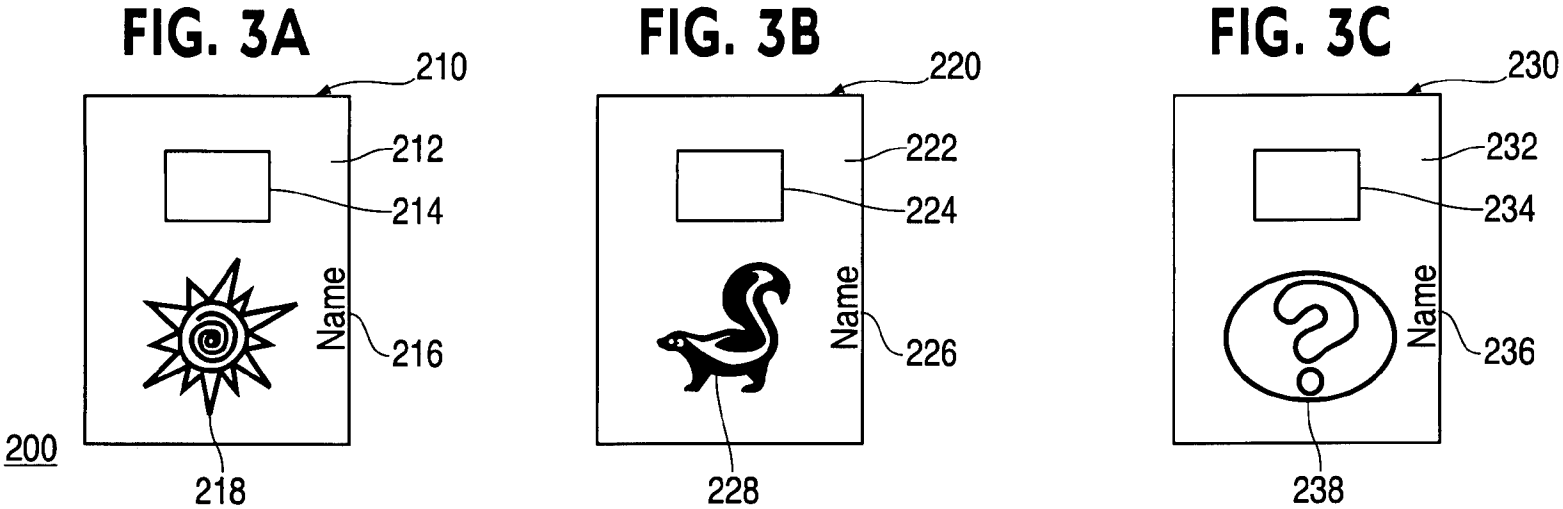
FIGS. 3A, 3B, 3C, 3D, 3E, and 3F are illustrations of a scent generating device suitable for use with the embodiment of FIG. 1.
Figure 4A:
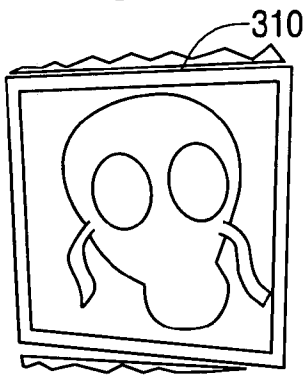
FIGS. 4A, 4B, 4C, 4D, 4E, and 4F are illustrations of position markers suitable for use with the embodiment of FIG. 1.
Figure 4B:
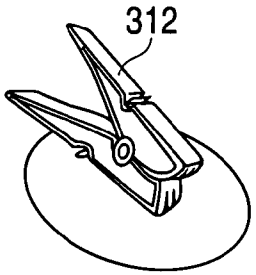
Figure 4C:
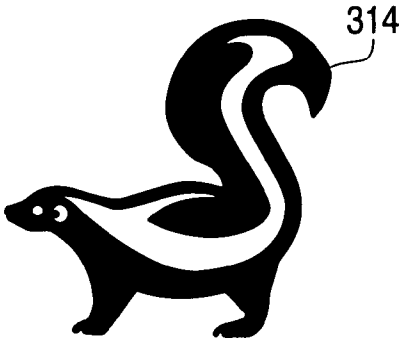
Figure 4D:
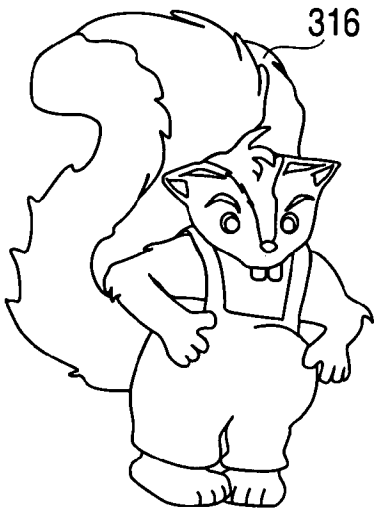
Figure 4E:
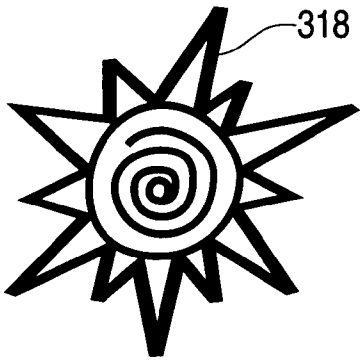
Figure 4F:
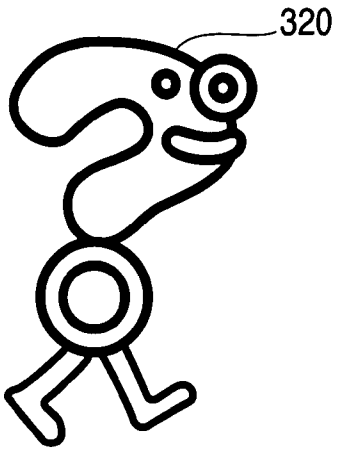

FIG. 3 illustrates a variety of suitable scent generating devices 200 according to various embodiment. As shown in FIG. 3, three types of scent generating devices—good smell card 210, bad smell card 220, and mystery smell card 230—according to one of the embodiments. Each smell card 210, 220, 230 includes, a first side 240, 244, 250 with at least one scented area. For example, smell card 210 having one scented area 242, smell card 220 having two scented areas 246*a* and 246*b*, and smell card 230 having six scented areas 252*a*-252*f* are also possible. Each smell card has a second side 212, 222, 232 with the identity of the scents 216, 226, 236 and an order 214, 224, 234. These examples are illustrative and not limiting in nature.

In an embodiment, the first side 240 contains one scented area 242. This area may be in any suitable shapes. Examples of suitable shape include: square, ellipse, triangular, circular, strip, or irregular. This scented area 242 may contain any suitable scents—good smell or bad smell. Examples of good smell include: chocolate, apple, cherry, grape, strawberry, and the like. Examples of bad smell include: garlic, dirt, smoke, sulfur, trash, and the like. These examples are illustrative and not limiting in nature. Mystery cards 230 may contain either good smell, bad smell, or both. The scented cards 210, 220, 230 are set apart from each other by any suitable color and design. For example, the good smell card 210 has a sun symbol 218, the bad smell card 220 has a skunk symbol 228, and the mystery card 230 has a question mark 238. These examples are illustrative and not limiting in nature.

In an embodiment, the second side 212, 222, 232 contains the identity of the scent 216, 226, 236 and an order 214, 224, 234. The identity of the scent 216, 226, 236 is printed on the card 210, 220, 230 and is visible to the players. Alternatively, the identity of the scent 216, 226, 236 may be printed on the card using any suitable means and is invisible from the player. Examples of a suitable mean include: an invisible ink and the identity may be made visible by placing a clear decoding card over the second side of the card. The order 214, 224, 234 is an instruction for the player, indicating their action upon the correct or incorrect identifying of the scent. For example: move 2, 5, or 10 steps forward, throw the dice again, miss a turn, go back to start, move 2, 5 or 10, draw a good smell card, draw a bad smell card, draw a mystery smell card, and the like. These examples are illustrative and not limiting in nature.

In one embodiment, the scented areas 242, 246*a*, 246*b*, 252*a*-252*f* on the cards 210, 220, 230 are micro-encapsulated using known techniques that allow the scent or smell to be released by scratching the scented area and breaking the beads or capsules containing the scented material. In addition, the scented areas 242, 246*a*, 246*b*, 252*a*-252*f* can be made using the following techniques: scratch & sniff, snap & burst, peel & reveal, micro varnish, micro emulsions, fragrances, and any technique that can be used to deliver smell on a card. These examples are illustrative and not limiting in nature.

Furthermore, the cards 210, 220, 230 may contain more than one scented areas 242, 246*a*, 246*b*, 252*a*-252*f*. For example, a scented card 230 having six or more scented areas 252*a*-252*f* on the card is shown. In addition, the scented areas 252*a*-252*f* may contain more than one scent. For example, there can be two different scented areas and each contains a different scent. These examples are illustrative and not limiting in nature.

Alternatively, the good 210, bad 220 and mystery 230 cards can be substituted with other unique smells. Players can purchase additional cards having specific themes. For example: a set of cards with flower scent, herb scent, perfume scent, coffee scent, beer scent, wine scent, fruit scent, and the like. These examples are illustrative and not limiting in nature.

Furthermore, players may also purchase additional theme backgrounds with the special scented cards having specific themes. For example, a Christmas theme may include theme scents such as pumkin pie, evergree tree, fruit cake, ginger bread, and the like; and a Thanksgiving theme may include theme scents such as rosted turkey, sweet potato, cranberries, and the like. These examples are illustrative and not limiting in nature.

When a player picks up the card 210, 220, 230, the player will have to scratch the scented areas 242, 246*a*, 246*b*, 252*a*-252*f* and guess the scent. If they guess the smell correctly they get to play again. If they guess the smell incorrectly, they incur a penalty, for example, remain in their space.

In the electronic format, a scent generating device (not shown) is used with the gaming apparatus. The player presses a button to release the smell of the card or presses a button to scratch the card shown on the screen. In the online format, the player uses an input device such as a mouse or arrow keys on the keyboard, or LCD touch screen to scratch the card shown on the screen. In either version, when the card is scratched, the smell is released by an odor generation apparatus attached to the computer through a USB port or other attachment or interface means.

The Position Marker

FIG. 4 shows various types of position markers 310, 312, 314, 316, 318, 320 that a player may use to mark the location of the player during the game. The position marker can be any suitable game pieces. Examples of suitable game pieces include: pegs, cardboard cutout, plastic figures, and the like. These pieces may be characters in the game or are objects used to prevent or create smells such as, for example, gas mask, clothesline pins, bowls of chili, or bean burritos. These examples are illustrative and not limiting in nature.

In addition, player may also choose to use other types of position markers, such as: dry erase pen, color pencils, or other markers to mark their position on the game path. These examples are illustrative and not limiting in nature.

The Movement Determinating Device

Figure 5C:
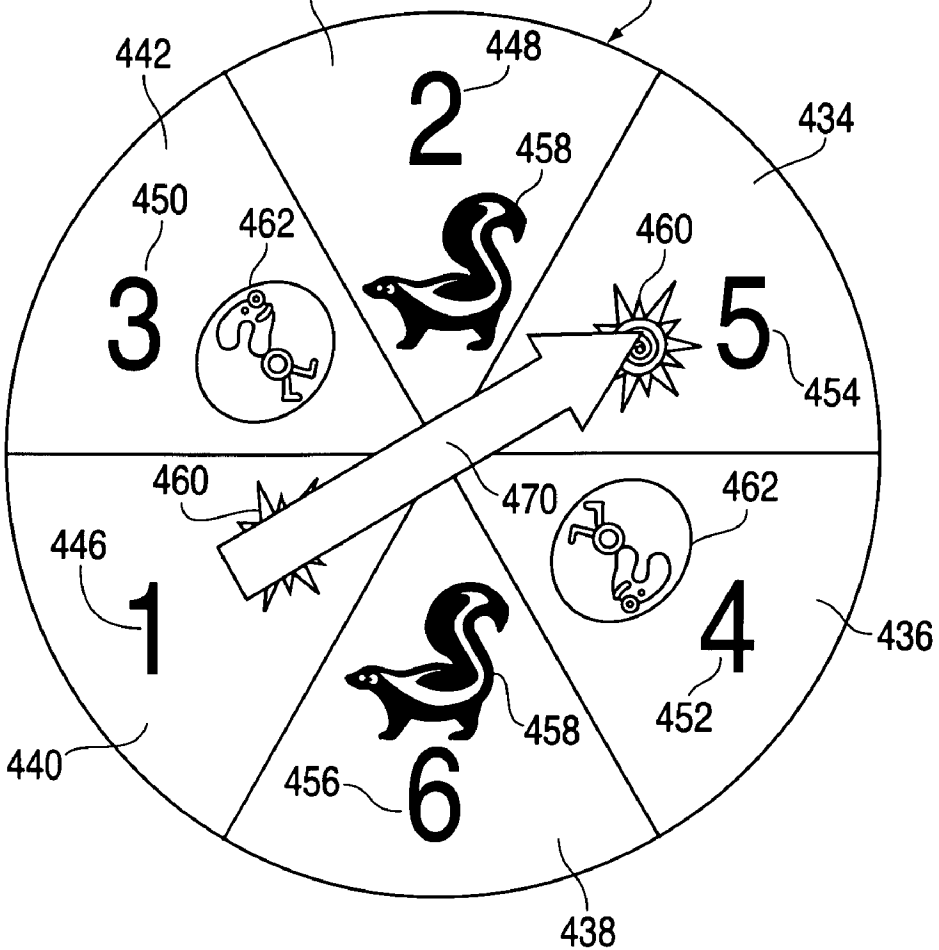
FIGS. 5A, 5B, and 5C are illustrations of devices for generating movement instruction suitable for use with the embodiment of FIG. 1.
Figure 5A:
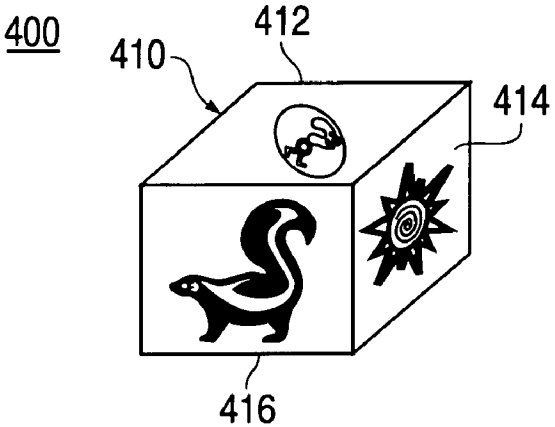
Figure 5B:
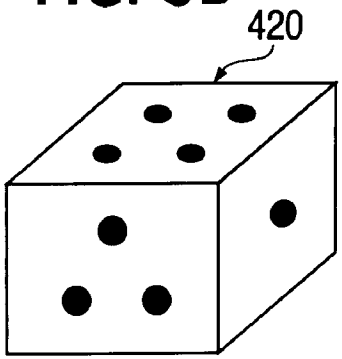

FIG. 5 shows various devices 410, 420, 430 for generating movement instruction. The movement generating device may be any suitable chance devices. Example of suitable chance devices include: a single die 420, a custom die 410, a spinner 430, a bag with a series of numbers (not shown), and the like. Any other suitable chance determining element may be provided for the operation of the game. These examples are illustrative and not limiting in nature.

The custom die 410 is made so that two faces of each individual die has a picture of a skunk 416 on it, two faces of the die has a question mark 412 on it, and two face of the dice has a sun symbol 414 on it. The spinner 430 is designed the same way, with numbers 1 through 6 (446, 448, 450, 452, 454, 456) or the graphics of a skunk 458, a sun symbol 460, and a question mark 462. When using the custom die 410 or spinner 430 with graphics, the player advances to the next space of the path indicated by the graphics. For example, if a player receives a sun symbol 414, 460, the player will move to the next space with a sun symbol on it. Similarly, if a player receives a skunk 416, 458 or question mark symbol 412, 462, the player will move to the space with a skunk or question mark symbol on it, respectively. If the player uses a regular dice of a spinner with numbers, the player advances the number of spaces indicated by the dice of the spinner. For example, if the player receives a four using a dice or a spinner, the player advances four spaces on the playing path. In the alternative, the playing path 112 can also be represented by different colors in place of the characters or symbols.

In the electronic embodiment, the player presses a button or an input device to spin the spinner or roll the dice. In the online version, the player will have to use the mouse, the arrow keys on the keyboard, or other suitable input device, such as CD touch screen to spin the spinner or roll the dice. These examples are illustrative and not limiting in nature.

Rules for Playing the Game

Figure 6:
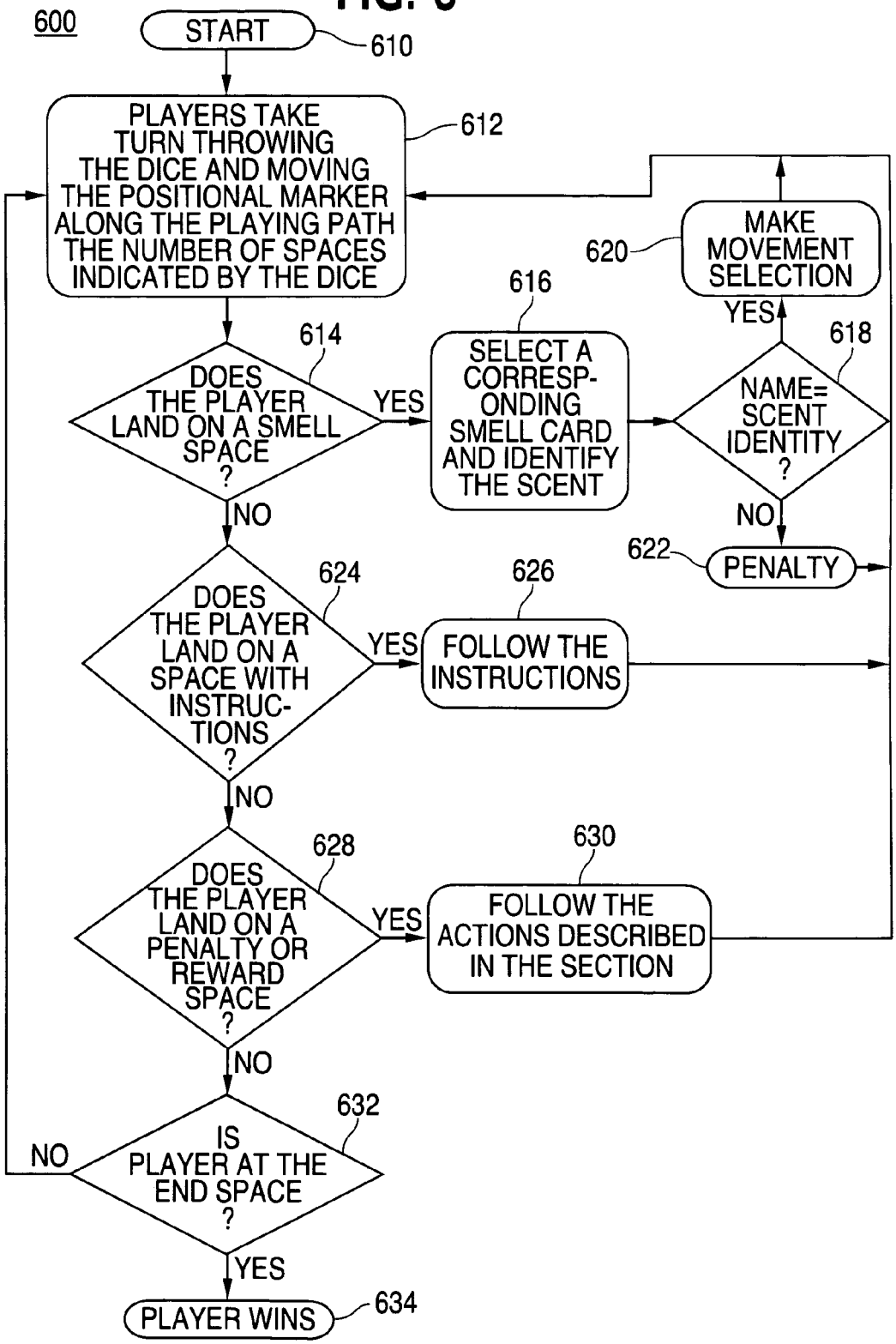
FIG. 6 is a flow diagram of the progress of the game according to an embodiment of the invention.

FIG. 6. is a flow diagram of a method 600 according to an embodiment of the invention. At step 610, to start the game, players may gather parts of the game: the playing surface 110, scented cards, 210, 220, 230, position markers 310, 312, 314, 316, 318, 320, and movement determining device 410, 420, 430. The players may place the scented cards 210, 220, 230 in the corresponding areas 126*a*, 126*b*, 126*c* on the playing surface 110. Each player may select a positional marker. Players determine their play order by using any, all, or any combination of the movement determining device 410, 420, 430. The player with the highest number goes first, the second highest goes next and so forth. Alternatively, if an adult is playing with a child, the child can be allowed to go first, or the lowest number can go first.

At step 612, once the player order is decided, beginning at the start space 114, the first player use the movement determining device to decide where the player will move on the playing path 112. The player can land on a penalty space 118*a*, an instruction space 118*b*, a smell space 118*c*, 118*f*, 118*h*, reward space 118*e*, or other special spaces. Examples for special spaces include: jail, toilet bowl, or the like. These examples are illustrative and not limiting in nature.

At step 614, it is determined whether the positional marker 310 is disposed upon the smell space 118*c*, 118*f*, 118*h*. In the event that the positional marker 310 is disposed upon a smell space 118*c*, 118*f*, 118*h*, a corresponding smell card 210, 220, 230 may be selected and the identity of the smell may be guessed at step 616.

At step 616, the player will scratch the scented area 242, 246*a*, 246*b*, 252*a*-252*f*, sniff the area and try to identify the scent at step 618.

At step 620, if the player answers correctly, the player can: (a) follow the order 214, 224, 234 on the card, (b) stay at the space and request the next player to follow the order (this will happen if the player will land on a penalty space by moving forward), or (c) throw the dice again, move forward to the indicating space and follow the instruction. The player will continues back at step 612 until a player reaches step 632 and declares as the winner at step 634.

At step 622, if the player answers incorrectly, then the player receives a penalty. The player will remain on the space and wait until other players have a chance to move along the path before continuing with step 612. The player will continues until a player reaches step 632 and declares as the winner at step 634.

At step 624, when a player lands on an instruction space 118, the player will follow the instructions at step 626 indicated on the space 118. Examples of instructions are: move 2, 5, or 10 steps forward, throw the dice again, miss a turn, go back to start, move 2, 5 or 10, draw a good smell card, draw a bad smell card, draw a mystery smell card, and the like. Upon completing the instructions, the player continue with step 612 until a player reaches step 632 and declares as the winner at step 634.

At step 628, when a player lands on a penalty space 118*a* or reward space 118*e*, the player may follow the actions 122*a*, 122*b* that are indicated in the corresponding sections 120*a*, 120*b* at step 630. Examples of penalties space and reward spaces are: miss a turn, go back to start, move 2, 5 or 10, draw a bad smell card, and draw a mystery smell card. Some reward can be move 2, 5 or 10 steps forward, throw the dice again, draw a good smell card, skip some spaces, move immediately to another space, and the like.

When a player lands on the other spaces, the player will follow instruction accordingly. For example: if the player lands on a jail or toilet bowl spot, the player can only resume the game by throwing a six with the dice or other movement determinative device. These examples are illustrative and not limiting in nature.

Each player will take turns on moving along the path at steps 612, 614, 624, 628 (as discussed above) using the dice until the first player arrives at the end space 116 and declares as the winner of the game at step 634.

In one embodiment, after identifying the scent, the player returns the game card to the bottom of the card pile before proceeding with the move to the next space. In the alternative, the players can also elect to keep the scented cards upon correct identifying of the scent.

In another embodiment, the path is neither color coded nor placed with character or symbols. Players will mix all the scented cards in one pile and the player will identify the scent on the card during their turn. In this embodiment, the scent card can either be a good smell card or a bad smell card. The player can move forward if the player correctly identify the scent. However, the player incurs penalty if the player incorrectly identify the scent.

Figure 7:
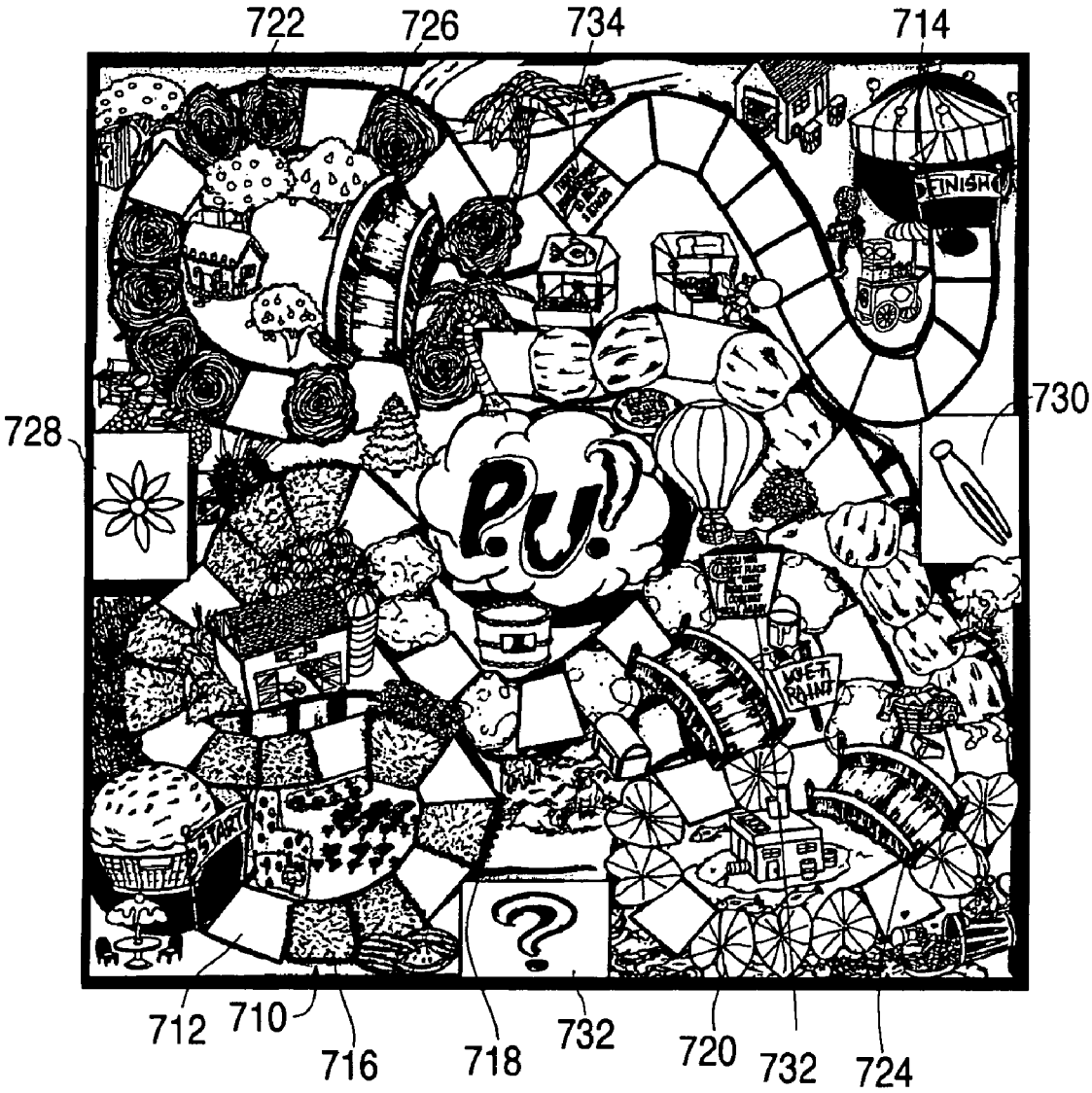
FIG. 7 is an illustration of an example of a game board.

FIG. 7 is yet another example of the possible layout of game board. In this example, the path 710 having a start space 712, an end space 714, and a set of spaces that resemble grass 716, stone 718, leave 720 and wood 722 in between the start space 712 and the end space 714. There are short-cuts 724, 726 (as many as desired) between the spaces, where the players can use the short-cuts 724, 726 to bypass obstacles or penalties. On the left side, right side, and bottom of the game show three spaces 728, 730, 732 for the scented cards (FIG. 3). The flower symbol space 728 is the location for the good smell cards 210, the nose clip symbol space 730 is the location for bad smell cards 220, and the question mark space 732 is for mystery smell cards 230. The path also contains reward space 732 and penalty space 734. These examples are illustrative and not limiting in nature.

Figure 8:
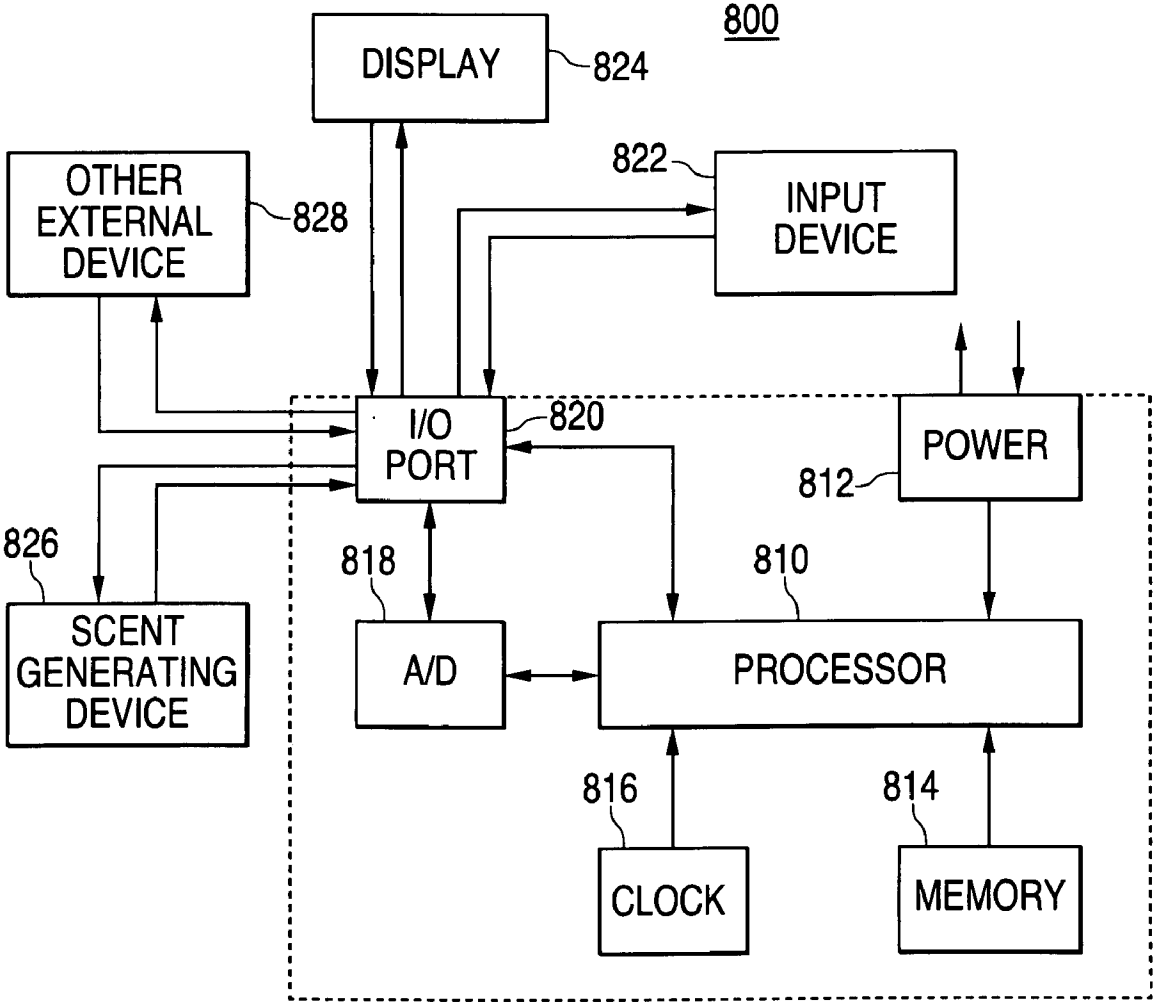
FIG. 8 is a system architecture for the computing device suitable for use with an electronic game according to FIG. 1.

FIG. 8 is a system architecture for the computing device 800 suitable for use with an electronic game 10 according to FIG. 1. As shown in FIG. 8, the computing device 800 includes a processor 810. This processor 810 is operably connected to a power supply 812, a memory 814, a clock 816, an analog to digital converter (A/D) 818, and an input/output (I/O) port 820. The memory 814 is configured to store data received from the processor 810. The I/O port 820 is configured to receive signals from any suitably attached electronic device and forward these signals to the A/D 818 and/or the processor 810. For example, the I/O port 820 may receive signals associated with an input device 822 and forward the signals to the processor 810. Furthermore, the I/O port 820 is configured to forward the signals from the processor 810 to a scent generating device 826. If the signals are in analog format, the signals may proceed via the A/D 818. In this regard, the A/D 818 is configured to receive analog format signals and convert these signals into corresponding digital format signals. Conversely, the A/D 818 is configured to receive digital format signals from the processor 810, convert these signals to analog format, and forward the analog signals to the I/O port 820. In this manner, electronic devices configured to receive analog signals may intercommunicate with the processor 810.

The display 824 is configured to provide visual information to a player. In another form, the display 824 may include a touch screen configured to provide a data entry capacity to the user. In this regard, the display 824 and/or the input device 822 is configured to provide the player with the capability to communicate with the processor 810.

The processor 810 is configured to receive and transmit signals to and from the A/D 818 and/or the I/O port 820. The processor 810 is further configured to receive time signals from the clock 816. In addition, the processor 810 is configured to store and retrieve electronic data to and from the memory 814. Furthermore, the processor 810 is configured communicate with I/O port 820 to direct the scent generating device 826 to emit a scent. In addition, other external device 828 such as a CD, DVD, hard drive and the like can also be in communication with I/O port 820.

This system for playing a game can exist in a variety of forms both active and inactive. For example, they can exist as software program(s) comprised of program instructions in source code, object code, executable code or other formats. Any of the above can be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), flash memory, and magnetic or optical disks or tapes. Exemplary computer readable signals, whether modulated using a carrier or not, are signals that a computer system hosting or running the computer program can be configured to access, including signals downloaded through the Internet or other networks. Concrete examples of the foregoing include distribution of the HTML builder classes, their extensions or document-producing programs on a CD ROM or via Internet download. In a sense, the Internet itself, as an abstract entity, is a computer readable medium. The same is true of computer networks in general.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A game for at least one player, comprising:

a plurality of cards, each comprising a first side and a second side, the first side comprising a plurality of scented areas, each scented area comprising a scent of an identifiable object that is different from the other scented areas, the second side comprising the identity corresponding to each scented area, and an instruction indicating an action to be performed upon a correct identification of the object by the player;

a playing path having a start and an end;

a section comprising:

(i) a set of spaces disposed between said start and said end and (ii) an indicia of action corresponding to a subset of said set of spaces, wherein the indicia instructs the player to relocate on the playing path; and a positional marker to mark a position on said playing path.

2. The game according to claim 1, further comprising a movement determining device to determine an advancement for said positional marker along said playing path.

3. The game according to claim 1, wherein said cards are selected from a group consisting of good smell, bad smell and mystery smell cards.

4. The game according to claim 1, wherein said scented area includes a scratch and sniff region to generate said scent.

5. The game according to claim 1, wherein said set of spaces are selected from a group consisting of instruction spaces, penalty spaces, reward spaces and smell spaces.

6. The game according to claim 5, wherein said instruction spaces, penalty spaces and reward spaces provide a direction for said player to follow.

7. The game according to claim 1, wherein said game is a board game.

8. The game according to claim 1, wherein a theme surface is placed over said playing path.

9. The game according to claim 1, wherein additional cards are purchased separately.

10. A method of playing a scent-based board game, comprising:

(a) moving a positional marker along a playing path on a game board, wherein said playing path includes:

(i) a start;

(ii) an end; and (iii) a section having a set of playing spaces, wherein a first subset of said set of spaces comprises an indicia of action, a second subset of said set of spaces corresponding to a plurality of scented cards;

(b) picking a scented card, which is selected from a group comprising good smell, bad smell, and mystery smell cards, wherein the scented card having a first side and a second side, the first side comprising a plurality of scented areas, each scented area having a different scent of an identifiable object, the second side comprising the identity of the corresponding each scented area, and an instruction indicating an action to be performed upon a correct identification of the object;

(c) identifying a scent from the plurality of scented areas of the identifiable object on the scented card; and (d) following said action in response to correctly identifying said scent.

11. The method according to claim 10, further comprising advancing said positional marker along said playing path using a movement determining device.

12. The method according to claim 10, further comprising:

(a) performing said action indicated on said scented card;

(b) staying at said playing space; or (c) advancing to a next playing space using said movement determining device and following said indicia of action on said space.

13. The method according to claim 10, further comprising staying at said playing space.

14. The method according to claim 10, further comprising following said indicia of action on said playing space.

15. The method according to claim 10, further comprising following said indicia of action in said section.

16. The method according to claim 10, further comprising declaring as winner said player who first arrives at said end space.

17. The method according to claim 10, wherein said player collects said card along said path as said player correctly identifying said scent.

18. A game for at least one player, comprising:

a playing path on a board having a start and an end;

a section on the board comprising:

(i) a set of spaces disposed between said start and said end of the playing path and (ii) an indicia of action printed on a subset of said set of spaces, wherein the indicia instructs the player to relocate on the playing path;

a plurality of cards, each comprising a first side and a second side, the first side comprising a plurality of scented areas, each scented area having a scent of an identifiable object different from the other scented areas, the second side comprising a name or an illustration of the identifiable scent of the object and an instruction, wherein the instruction instructing the player to move forward on the playing path upon a correct identification of the object by the player; and a positional marker to mark a position on said playing path.

* * * * *